United States Patent [19]

Nixon et al.

[11] Patent Number: 4,837,547

[45] Date of Patent: Jun. 6, 1989

[54] THERMAL CUTOFF ASSEMBLY

[75] Inventors: Ronald A. Nixon; Charles Yagher, Jr., both of Lexington, Ohio

[73] Assignee: Therm-O-Disc, Incorporated, Mansfield, Ohio

[21] Appl. No.: 115,379

[22] Filed: Nov. 2, 1987

[51] Int. Cl.[4] ..... H01H 37/76

[52] U.S. Cl. ..... 337/414; 34/30; 337/398; 219/363

[58] Field of Search ..... 337/398–417; 34/30; 169/42; 219/363; 236/DIG. 19; 374/29, 30, 132, 133, 188; 174/17 VA

[56] References Cited

U.S. PATENT DOCUMENTS 663,419 12/1900 Cortland ..... 337/398
4,122,329 10/1978 Godel ..... 219/363

FOREIGN PATENT DOCUMENTS 416870 1/1967 Switzerland ..... 219/363

*Primary Examiner*—H. Broome
*Attorney, Agent, or Firm*—Jones, Day, Reavis & Pogue

[57] ABSTRACT

A thermal cutoff is mounted adjacent a bleed opening in a hot air duct. Hot air flowing through the bleed opening mixes with ambient air before contacting the thermal cutoff. If a predetermined air temperature is exceeded, the thermal cutoff operates, and de-energizes the air heater.

21 Claims, 3 Drawing Sheets

Fig. 1
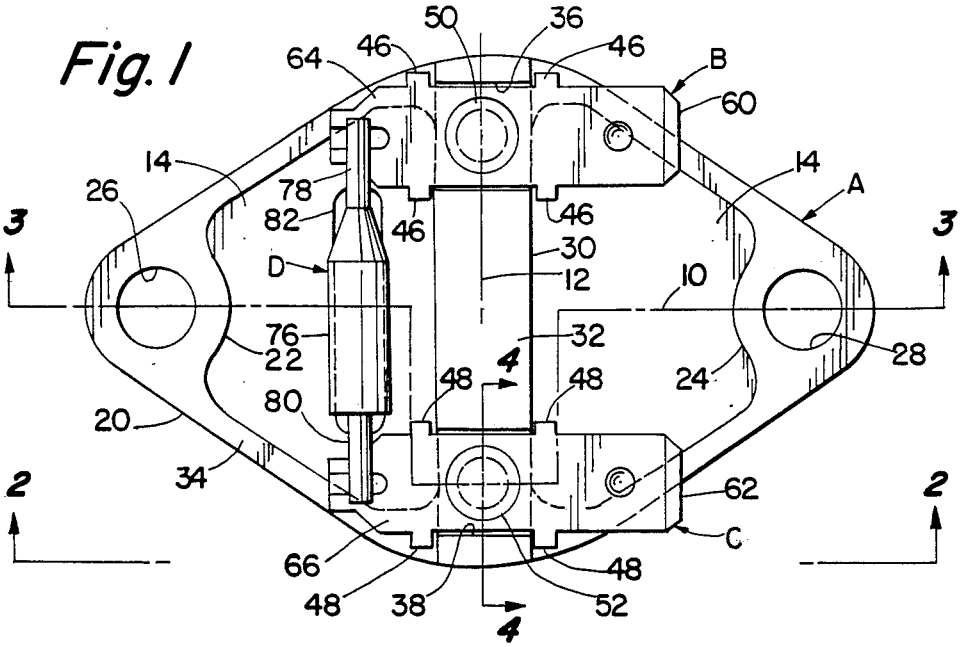
Fig. 2
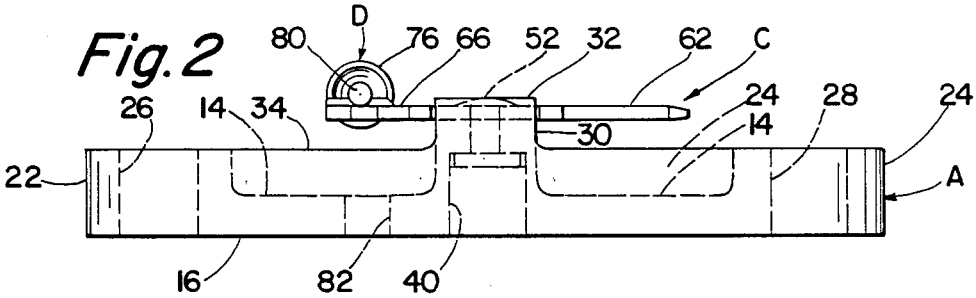
Fig. 3
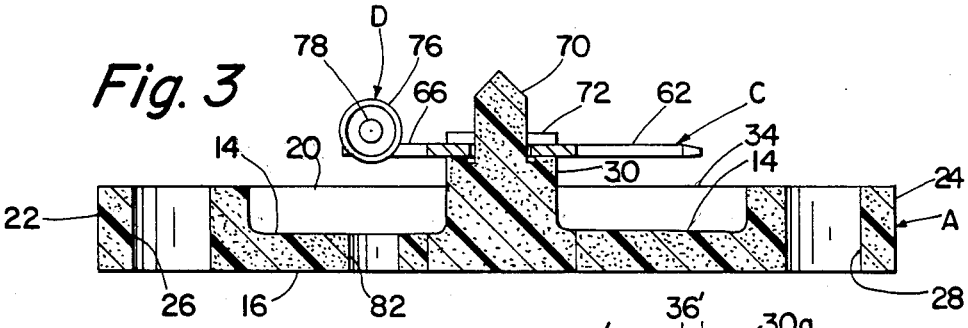
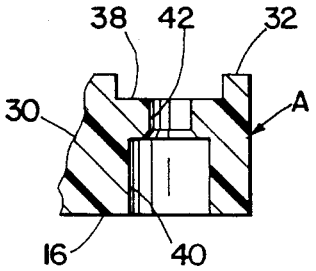
Fig. 4
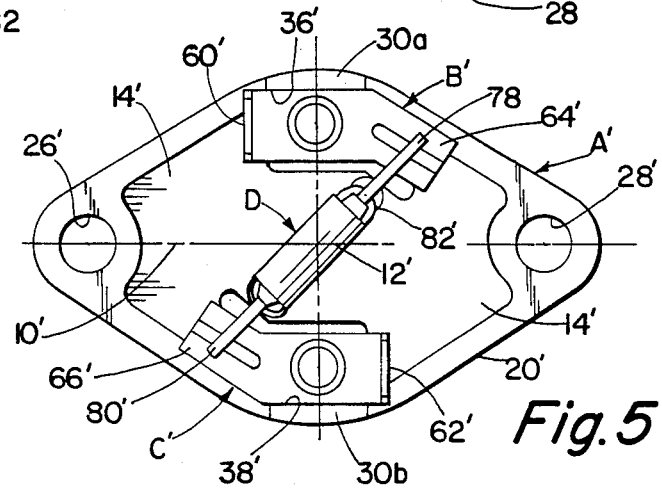
Fig. 5

Fig. 11
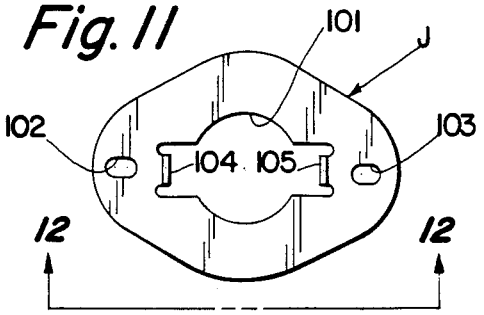
Fig. 12
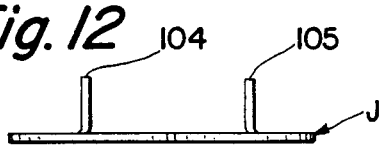
Fig. 13
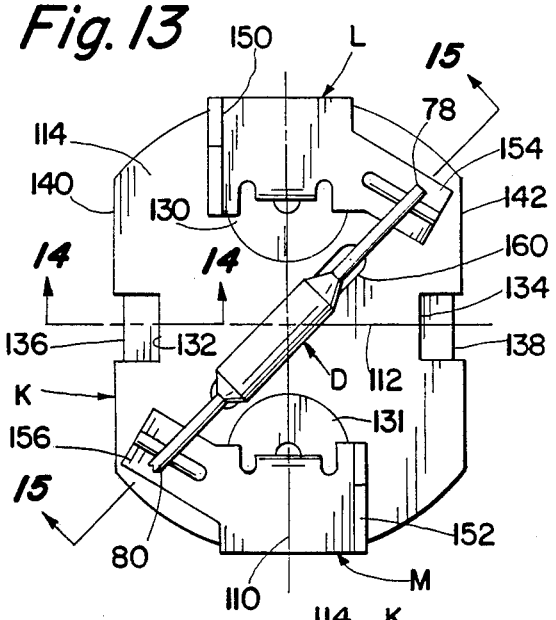
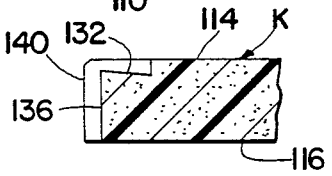
Fig. 14
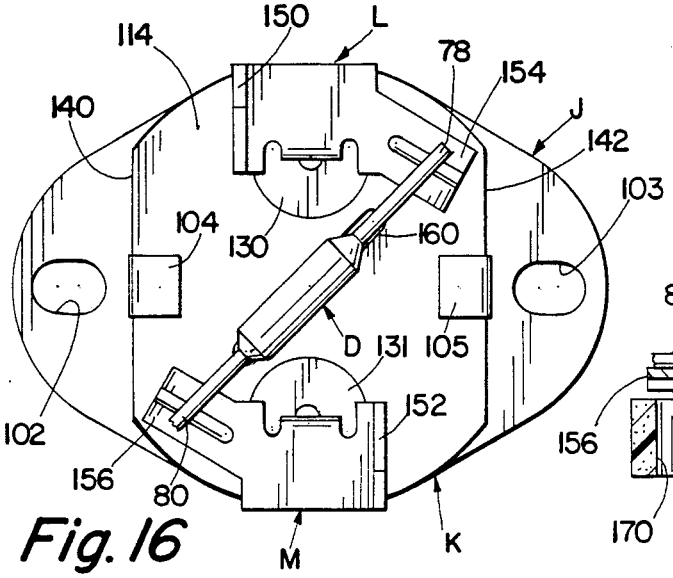
Fig. 16
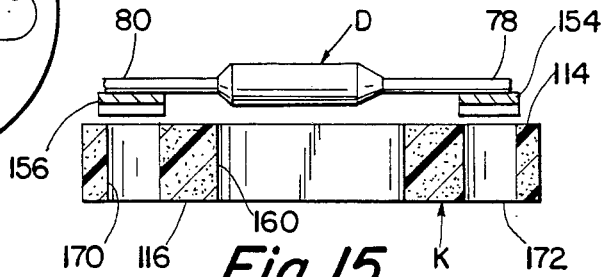
Fig. 15
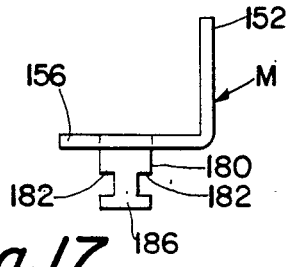
Fig. 17
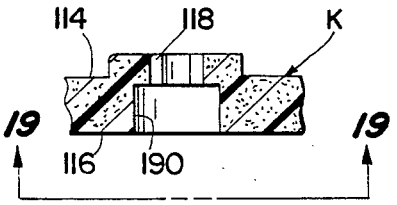
Fig. 18
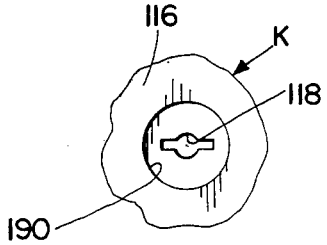
Fig. 19
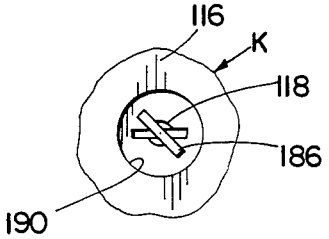
Fig. 20

THERMAL CUTOFF ASSEMBLY

BACKGROUND OF THE INVENTION

This application relates to the art of temperature sensing and, more particularly, to sensing of excessive temperatures. The invention is particularly applicable for use with clothes dryers or the like, and will be described with specific reference thereto. However, it will be appreciated that the invention has broader aspects, and can be used for protecting against excessive temperatures in other environments.

Clothes dryers commonly have a thermostat for cycling a heater on and off to maintain a desired temperature. A thermostat can fail in a closed position, and the resulting excessive temperatures create a fire hazard. It is known to have safety devices for de-energizing the heater in the event of a thermostat failure. However, previous arrangements have been complicated and expensive, as by using dual thermostat assemblies.

SUMMARY OF THE INVENTION

A clothes dryer heater box or duct has a bleed opening through which hot air flows. A thermal cutoff is mounted adjacent the bleed opening, and is connected in series with the heater. The temperature of the air is much higher than the rating of the thermal cutoff. Therefore, the thermal cutoff is mounted such that hot air flowing through the bleed opening mixes with ambient air before contacting the thermal cutoff. In the event of a thermostat failure, the air will become so hot that even mixing with ambent air will be insufficient to prevent operation of the thermal cutoff. Upon operation of the thermal cutoff, the heater is de-energized, and cannot be re-energized until the thermal cutoff is replaced, and the cause of the over-temperature condition corrected.

In one arrangement, the thermal cutoff assembly of the present application includes a mounting base having a generally oval peripheral shape including major and minor axes. The mounting base has front and rear surfaces, and means for mounting electrical connector terminals and a thermal cutoff thereto.

An air flow passage extends through the mounting base between the front and rear surfaces. The thermal cutoff is mounted in outwardly-spaced relationship to the front surface in alignment with the air flow passage.

The mounting base is mounted to a clothes dryer duct or heater box, and the air flow passage is aligned with a bleed opening. Hot air flowing through the air flow passage mixes with ambient air adjacent the front surface of the mounting base before engaging the thermal cutoff. If a predetermined air temperature at the thermal cutoff is exceeded, the thermal cutoff will operate and interrupt the heater.

It is a principal object of the present invention to provide an improved temperature sensing arrangement for clothes dryers or the like.

It is another object of the invention to provide an improved mounting base for a thermal cutoff.

It is an additional object of the invention to provide a mounting base for a thermal cutoff which is relatively simple and economical to manufacture and install.

It is a further object of the invention to provide an improved arrangement for protecting clothes dryers or the like against excessive temperature conditions that may create fire hazards.

BRIEF DESCRIPTION OF THE DRAWINGS

FIG. 1 is a front elevational view of a thermal cutoff assembly constructed in accordance with the present application;

FIG. 2 is a side elevational view taken generally on line 2—2 of FIG. 1;

FIG. 3 is a cross-sectional elevational view taken generally on line 3—3 of FIG. 1;

FIG. 4 is a partial cross-sectional elevational view taken generally on line 4—4 of FIG. 1, and with portions omitted for clarity of illustration;

FIG. 5 is a front elevational view of another embodiment;

FIG. 11 is a top plan view of a mounting bracket;

FIG. 12 is a side elevational view taken generally on line 12—12 of FIG. 11;

FIG. 13 is a top plan view of a thermal cutoff assembly used with the bracket of FIGS. 11 and 12;

FIG. 14 is a partial cross-sectional elevational view taken generally on line 14—14 of FIG. 13;

FIG. 15 is a cross-sectional elevational view taken generally on line 15—15 of FIG. 13, and with portions omitted for clarity of illustration;

FIG. 16 is a top plan view showing the assembly of FIG. 13 attached to the bracket of FIGS. 11 and 12;

FIG. 17 is a side elevational view of a terminal used with the assembly of FIG. 13;

FIG. 18 is a partial cross-sectional elevational view showing a hole in the base of the FIG. 13 assembly for mounting the terminal of FIG. 17 to such base;

FIG. 19 is a bottom plan view taken generally on line 19—19 of FIG. 18; and FIG. 20 is a view similar to FIG. 19, and showing the terminal of FIG. 17 attached to the base.

DESCRIPTION OF THE PREFERRED EMBODIMENTS

Figure 6:
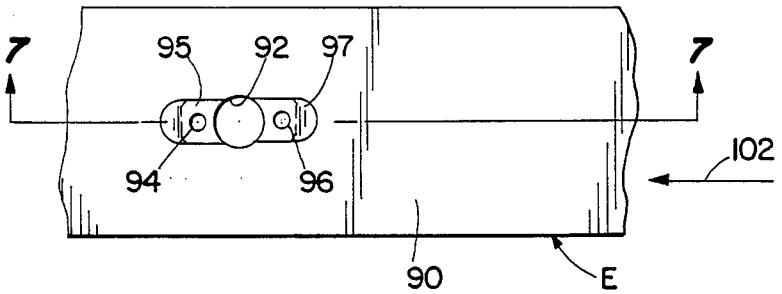
FIG. 6 is an elevational view of a portion of a clothes dryer duct or heater box having a bleed opening therein.

Referring now to the drawing, wherein the showings are for purposes of illustrating certain preferred embodiments of the invention only, and not for purposes of limiting same, FIG. 1 shows a thermal cutoff assembly including a ceramic mounting base A having a generally oval peripheral shape including major and minor axes 10, 12. Mounting base A may also be considered to be generally diamond-shaped 'with smoothly rounded corners.

Mounting base A has substantially flat and parallel front and rear surfaces 14, 16. A peripheral wall 20 extends upwardly from front surface 14 substantially perpendicular thereto. At the opposite end portions of mounting base A located on major axis 10, wall 20 is enlarged into generally circular bosses 22, 24 having holes 26, 28 therethrough. Holes 26, 28 extend substantially perpendicular to front and rear surfaces 14, 16, and their centers intersect major axis 10.

Suitable fasteners, such as rivets or screws, are extended through holes 26, 28, and through suitable holes in the wall of a duct o heater box for attaching mounting base A to such wall. Thus, holes 26, 28 define securing means for securing base A in position.

Peripheral wall 20 preferably extends upwardly from front surface 14 a distance at least as great as the thickness of base A between front and rear surfaces 14, 16. Front surface 14 is actually located in a depression surrounded by peripheral wall 20.

A central wall 30 coincidental with minor axis 12 bisects front surface 14. Central wall 30 extends upwardly from front surface 14 a greater distance than peripheral wall 20 such that central wall upper surface 32 is spaced outwardly from peripheral wall upper surface 34 as shown in FIGS. 2 and 3. Upper surface 32 of central wall 30 has recesses 36, 38 therein closely adjacent the opposite ends of central wall 30.

FIG. 4 shows a cylindrical bore 40 extending upwardly into central wall 30 from rear surface 16 in alignment with recess 38. A smaller hole 42 extends between bore 40 and the bottom of recess 38. It will recognized that a corresponding bore and hole extend into central wall 30 in alignment with recess 36. Substantially flat electrical connector terminals B, C are closely received in recesses 36, 38. Tabs 46, 48 extend outwardly from terminals B, C on opposite sides of central wall 30 adjacent recesses 36, 38. Terminals B, C have suitable holes therethrough aligned with the holes in central wall 30, such as hole 42 of FIG. 4, for receiving rivets 50, 52 for mounting terminals B, C to base A.

Each terminal B, C has a connector portion 60, 62 extending outwardly on one side of central wall 30, and a tail portion 64, 66 extending outwardly on the opposite side of central wall 30. Connector portions 60, 62 are adapted for reception in other terminal members.

FIG. 3 shows another arrangement in which bore 40 and hole 42 of FIG. 4 are replaced with an integral projection 70 extending upwardly from central wall 30. It will be recognized that there is a pair of projections 70, one for each terminal B, C. Projection 70 is closely received through the hole in a terminal member, and a push-on fastener 72 is received over projection 70 in gripping relationship thereto for holding the terminals against the bottoms of the recesses.

A thermal protector D has a generally cylindrical body 76, and opposite leads 78, 80 that are welded to tail portions 64, 66 of terminals B, C. In the arrangement shown, the longitudinal axis of thermal cutoff D extends substantially parallel to base minor axis 12.

An air flow passage 82 extends through mounting base A between front and rear surfaces 14, 16 thereof. Air flow passage 82 is elongated in a direction substantially parallel to minor axis 12 of base A. The length of air flow passage 82 is substantially greater than the width thereof. As shown in FIG. 1, the diameter of cylindrical body portion 76 of thermal cutoff D is greater than the width of air flow passage 82. It will be recognized that air flow passage 82 can have many other shapes, and that the diameter of thermal cutoff D does not necessarily have to be greater than the width of passage 82. The shape of the passage, and the relationship between the passage and cutoff, can vary depending upon the particular application and conditions.

Thermal cutoff D is mounted in upwardly spaced relationship to front surface 14 as shown in FIGS. 2 and 3. Thus, hot air flowing through air flow passage 82 mixes with ambient air adjacent front surface 14 before contacting thermal cutoff D. Thermal cutoff D is also spaced outwardly from outer surface 34 of peripheral wall 20. The spacing of cutoff D from front surface 14 is at least as great as the diameter of the cylindrical body portion of cutoff D. However, it will be recognized that other spacing relationships are possible.

In the arrangement of FIGS. 1–3, central wall 30, along with its associated recesses and holes or projections, defines mounting means for mounting thermal cutoff D in the position shown, and also defines means for mounting terminals B, C to base A.

FIG. 5 shows another arrangement wherein features corresponding to the embodiment of FIGS. 1–3 are given like numerals. A ceramic mounting base A′ has a front surface 14′, a peripheral wall 20′ and mounting holes 26′, 28′. Mounting bosses 30A, 30B have recesses 36′, 38′ for receiving electrical connector terminals B′, C′. Rivets or push-on fasteners may be used to secure terminals B′, C′ in position as in the embodiment of FIGS. 1–3. Connector portions 60′, 62′ are bent upwardly away from front surface 14′. Terminal tail portions 64′, 66′ have leads 78, 80 of thermal cutoff D welded thereto. An elongated air passage hole 82′ extends across the intersection of major and minor axes 10′, 12′. Thermal cutoff D is mounted in alignment with air flow passage 82′, and also extends across the intersection of major and minor axes 10′, 12′.

FIG. 6 shows a duct or heater box E of a clothes dryer having a substantially flat outer wall 90 with a circular bleed opening 92 therein. Holes 94, 96 on raised bosses 95, 97 on opposite sides of bleed opening 92 are spaced-apart the same distance as base mounting holes 26, 28 for receiving suitable fasteners. Hot air flows through duct or heater box E as indicated by arrow 102.

Mounting base A is mounted to wall 90 of duct or heater box E with elongated air flow passage 82 in alignment with bleed opening 92. Hot air bleeding through bleed opening 92 flows through air flow passage 82 and mixes with ambient air adjacent front surface 14 before contacting thermal cutoff D. In the event of a malfunction, the air will become overheated and cause thermal cutoff D to operate. Bosses 95, 97 also space base A outwardly from wall 90 of duct E such that some hot air escaping through duct opening 92 also flows around the sides of base A, and across part of the bottom thereof. The open area of flow passage 82 is substantially less than the open area of bleed opening 92.

Figure 8:
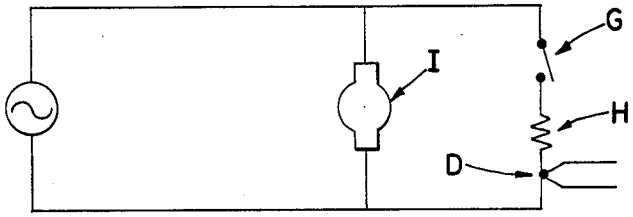
FIG. 8 is a schematic illustration showing a thermal cutoff connected in series with a clothes dryer heater.

FIG. 8 shows thermal cutoff D mounted in series with a thermostat G and a heater H. Thermostat G normally cycles on and off to regulate the temperature of the air. In the event thermostat G fails in a closed position, heater H will remain energized and result in an excessive temperature condition. In that event, the hot air contacting thermal cutoff D will cause same to operate for interrupting current flow to heater H.

Figure 9:
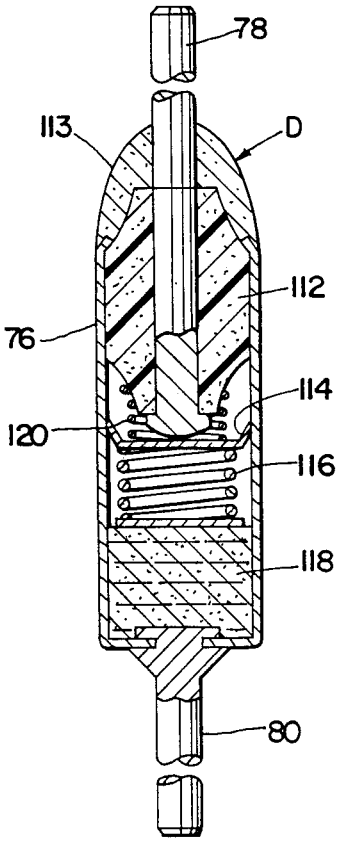
FIG. 9 is a cross-sectional elevational view of a closed thermal cutoff.
Figure 10:
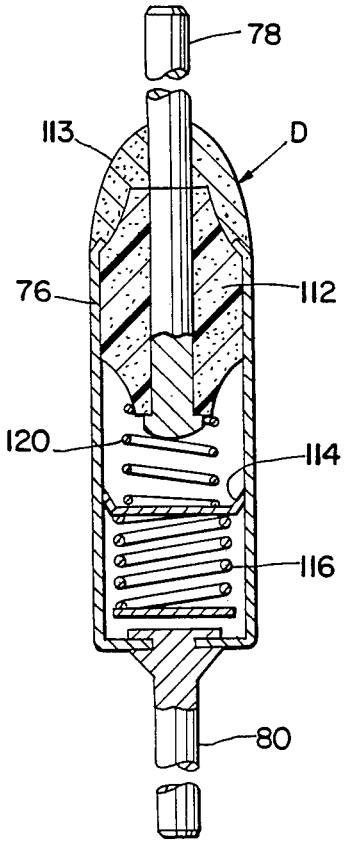
FIG. 10 is a cross-sectional elevational view of an open thermal cutoff.

It will be recognized that the thermal cutoff can take many forms. FIGS. 9 and 10 show one suitable thermal cutoff of a known type having lead 78 received in an insulator bushing 112, and covered by sealing compound 113. A star contact 114 slidable within conductive body 76 is biased into engagement with lead 78 by a spring 116. Star contact 114 has a plurality of circumferentially-spaced outwardly inclined resilient fingers that resiliently engage the interior of body 76. The opposite end of spring 116 acts against a thermal pellet 118 that may take many different forms. For example, compressed pellets of different organic materials will melt at different temperatures depending upon the application.

Caffeine and animal protein are examples of suitable pellet materials. Another spring 120 acts between insulator bushing 112 and the opposite side of sliding star contact 114. When the design temperature of thermal cutoff D is reached, thermal pellet 118 melts and allows spring 116 to expand. The reduced biasing force of spring 116 is then less than the force of spring 120 which biases star contact 114 away from lead 78 as shown in FIG. 9 to interrupt the flow of current.

FIGS. 11 and 12 show a mounting bracket J comprising a generally flat plate of stainless steel. An enlarged central hole 101 in bracket J is alignable with bleed hole 92 in duct E of FIG. 6, and both holes are of approximately the same diameter. Fastener receiving holes 102, 103 in bracket J are spaced-apart approximately the same distance as fastener receiving holes 94, 96 in duct E of FIG. 6. Elongated tabs 104, 105 are bent outwardly perpendicular to bracket J on opposite sides of central hole 101.

FIGS. 13–16 show a ceramic base K having major and minor bisecting axes 110, 112 that extend perpendicular to one another, and intersect at the center of base K. Front and rear surfaces 114, 116 extend substantially parallel to one another, and integral opposite raised bosses 130, 131 extend outwardly from front surface 114 on major axis 110.

Opposite recesses 132, 134 are provided in front surface 114 on minor axis 112, in alignment with opposite notches 136, 138 in base K opposite sides 140, 142.

Terminal members L, M are secured to bosses 130, 131. Each terminal member L, M has a connector terminal 150, 152 extending upwardly therefrom substantially perpendicular to base front surface 114. Each terminal member L, M also includes an integral flat tail portion 154, 156 extending outwardly therefrom substantially parallel to front surface 114, and in spaced relationship thereto.

An elongated slot 160 extends completely through base K, and is elongated in a direction extending between tail portions 154, 156 on terminal members L, M. Slot 160 extends across the intersection of major and minor axes 110, 112. Thermal cutoff D has its leads 78, 80 welded to the upper surface of terminal member tail portions 154, 156. Thermal cutoff D is spaced outwardly from base front surface 114, and is aligned with slot 160 for contact by warm air flowing therethrough. The diameter of thermal cutoff D is slightly larger than the width of slot 160. However, as previously indicated for the embodiments of FIGS. 1–5, other relationships between the thermal cutoff and air flow passage are possible. For example, the diameter of the thermal cutoff could be the same as, or smaller than, the air flow passage.

With reference to FIG. 15, holes 170, 172 extend completely through base K in alignment with terminal member tail portions 154, 156. Holes 170, 172 define apertures in base K through which welding electrodes are engageable with the bottom surfaces of connector terminal tail portions 154, 156. The distance between tail portions 154, 156 and front surface 114 is normally too small for positioning a welding electrode against the underside of a terminal member tail portion.

The distance between the bottom surfaces of notches 136, 138 is slightly less than the spacing between the facing surfaces on tabs 104, 105 of mounting bracket J. Ceramic base K is positionable on mounting bracket J with tabs 104, 105 closely received in notches 136, 138. The length of tabs 104, 105 is greater than the thickness of base K such that the outer end portions of tabs 104, 105 can be bent over into base recesses 132, 134 as shown in FIG. 16 for securing base K to bracket J. The assembly is then mountable to the duct as described for the other embodiments.

FIGS. 17–20 show how the terminal members are mounted to base K. FIG. 17 shows terminal member M having an integral attachment leg 180 extending downwardly therefrom substantially perpendicular to tail portion 156. Substantially flat attachment leg 180 has opposite notches 182 therein spaced slightly from the terminal end thereof to define a deformable web 184 and a locking tab 186.

FIGS. 18 and 19 show a slotted hole 188 completely through base K in alignment with boss 131. Slotted hole 188 is generally of a double reversed keyhole shape. An enlarged bore 190 extends into base K from rear surface 116 thereof in alignment with slotted hole 188. The lengths of attachment leg 180 and slotted hole 188 are such that locking tab 186 just clears slotted hole 188, and is located entirely within bore 190. Locking web 186 is then twisted about the longitudinal axis of attachment leg 180 to the position shown in FIG. 20 so it is out of alignment with slotted hole 188 to lock terminal member M to base K. The circular central portion of slotted hole 188 allows twisting of deformable web 184 on attachment leg 180.

Figure 7:
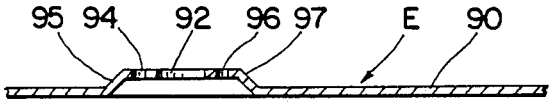
FIG. 7 is a partial cross-sectional elevational view taken generally on line 7—7 of FIG. 6.

Highly advantageous features of the assembly of the present application include reversibility of the base and the thermal cutoff. For example, the assembled bracket and base of FIG. 16 can be installed in the position shown or can be rotated 180° for installation. Therefore, no criticality is involved during attachment of the thermal cutoff assembly to the dryer. Likewise, thermal cutoff D can be installed in either of opposite directions. With reference to FIG. 16, cutoff D could be reversed so that lead 78 is welded to terminal tail portion 156, and lead 80 is welded to tail portion 154. Again, there is no criticality, and this makes it possible to assemble the parts with unskilled labor, or with automatic machinery. The substantially symmetrical arrangements of FIGS. 5 and 16 make reversibility of the entire assembly possible. The embodiment of FIG. 1 could also be reversed, and passage 82 would simply be closer to the right side of hole 92 in FIG. 7, instead of closer to the left side of such hole. The entire assembly of all embodiments is reversible about an axis perpendicular to the plane of the paper and passing through the intersection of the major and minor axes. In FIG. 5, the base is symmetrical on opposite sides of a line passing through the intersection of axes 10', 12' perpendicular to the longitudinal axis of slot 82'.

Although certain preferred embodiments of the invention have been shown and described for purposes of illustration, it is obvious that equivalent alterations and modifications will occur to others skilled in the art upon the reading and understanding of this specification. The present application includes all such equivalent alterations and modifications, and is limited only by the scope of the claims.

We claim:

1. A mounting base for a thermal cutoff, said base having front and rear surfaces, an air flow passage extending through said base between said front and rear surfaces, mounting means on said base for mounting a thermal cutoff to said base in alignment with said air flow passage and in spaced relationship to said front surface, securing means on said base for securing said base to a support with said rear surface facing the support and with said thermal cutoff on the opposite side of said base from the support, and connector terminals mounted on said base for connecting said thermal cutoff in an electrical circuit, whereby hot air flowing through said air flow passage from said rear surface toward said front surface mixes with ambient air adjacent said front surface before contacting the thermal cutoff.

2. The mounting base of claim 1 wherein said air flow passage is elongated in a direction substantially parallel to said front surface.

3. The mounting base of claim 1 including a peripheral wall extending upwardly around said front surface.

4. The mounting base of claim 1 wherein said mounting means performs the dual functions of mounting aid thermal cutoff to said base and also mounting said connector terminals to said base.

5. The mounting base of claim 1 wherein said base has a generally oval peripheral shape including major and minor axes, and said mounting means is located on said minor axis.

6. The mounting base of claim 1 wherein said base has a substantially oval peripheral shape including major and minor axes, and said air flow passage is elongated in a direction substantially parallel to said minor axis.

7. The mounting base of claim 1 wherein said base has a substantially oval peripheral shape including major and minor axes, and said air flow passage extends across said minor axis.

8. The mounting base of claim 7 wherein said air flow passage extends across said major axis.

9. The mounting base of claim 1 wherein said mounting means includes bosses extending upwardly from said front surface.

10. The mounting base of claim 1 wherein said air flow passage is elongated and has length and width dimensions, said mounting means being for mounting a substantially cylindrical thermal cutoff having a diameter greater than said width dimension.

11. The mounting base of claim 1 wherein said securing means comprises a bracket attached to said base.

12. The mounting base of claim 1 wherein said conductor terminals have tail portions and said base has apertures therethrough in alignment with said tail portions, said thermal cutoff having leads weldable to said tail portions, said apertures providing access to the rear of said connector terminal tail portions for welding said leaves thereto.

13. The base of claim 1 wherein said base is substantially symmetrical on opposite sides of a line passing through its center substantially perpendicular to said air flow passage.

14. Apparatus for sensing temperature in a duct through which hot gas flows and having a duct bleed opening through which hot gas bleeds, said apparatus comprising a mounting base having front and rear surfaces, a gas flow passage extending through said base between said front and rear surfaces, a thermal cutoff mounted on said base in alignment with gas flow passage and in spaced relationship to said front surface, securing means on said base for securing same to the duct with said rear surface facing the duct and with said gas flow passage aligned with the duct bleed opening, whereby hot gases flowing through said gas flow passage mix with ambient air adjacent said front surface before contacting said thermal cutoff.

15. The apparatus of claim 14 including bosses extending upwardly from said front surface, electrical connector terminals secured to said bosses, and said thermal cutoff being mounted on said terminals.

16. The apparatus of claim 15 wherein said base has a generally oval peripheral shape including major and minor axes, and said bosses lie on said minor axis.

17. The apparatus of claim 14 wherein said gas flow ge has a predetermined width, said thermal cutoff being substantially cylindrical and having a diameter greater than said predetermined width of said gas flow passage.

18. The apparatus of claim 14 wherein said thermal cutoff is substantially cylindrical and has a predetermined diameter, and said thermal cutoff being spaced from said front surface a distance at least as great as said predetermined diameter.

19. The apparatus of claim 14 including a central wall extending upwardly from and across said front surface, a pair of recesses in said wall, a pair of electrical connector terminals received in said recesses, means for securing said terminals to said wall in said recesses, said terminals having connector portions on one side of said wall and tail portions on the opposite side of said wall, and said thermal cutoff being secured to said tail portions.

20. The apparatus of claim 14 including electrical connector terminals secured to said base and having connector portions and tail portions, said tail portions overlying said front surface, said thermal cutoff having leads weldable to said tail portions and apertures in said base in alignment with said tail portions for access to the rear thereof to facilitate welding of said leads thereto.

21. In an apparatus of the type including a duct through which hot gases flow and having a bleed opening for bleeding hot gases therethrough, a mounting base having a thermal cutoff mounted thereon, a restricted hot gas flow passage through said base having an open area substantially less than the open area of said bleed opening, said base being secured to said duct in covering relationship to said bleed opening with said flow passage aligned with said bleed opening, and said thermal cutoff being aligned with said hot gas flow passage on the opposite side of said mounting base from said duct in outwardly-spaced relationship to said mounting base, whereby hot gases passing through said bleed opening mix with ambient air before contacting said thermal cutoff.

* * * * *